US005555620A

United States Patent [19]

Kies

[11] Patent Number: 5,555,620

[45] Date of Patent: Sep. 17, 1996

[54] METHOD OF MAKING ELECTRICAL CONNECTORS

[75] Inventor: Antonius M. Kies, Oisterwijk, Netherlands

[73] Assignee: Erico International Corporation, Solon, Ohio

[21] Appl. No.: 468,539

[22] Filed: Jun. 6, 1995

[51] Int. Cl.[6] ..... H01R 43/16

[52] U.S. Cl. ..... 29/874; 408/1 R

[58] Field of Search ..... 29/874, 884; 174/75 R, 174/84 R, 88 R, 88 B; 408/1 R, 204, 703

[56] References Cited

U.S. PATENT DOCUMENTS 3,930,522 1/1976 Turner ..... 138/111

4,693,644 9/1987 Takahashi ..... 408/703

*Primary Examiner*—P. W. Echols
*Assistant Examiner*—Adrian L. Coley
*Attorney, Agent, or Firm*—Renner, Otto, Boisselle & Sklar, P.L.L.

[57] ABSTRACT

A submersible bus type connector using hollow posts or flat pad posts is machined from conductive metal bar stock extrudate in a continuous machining line, to form the posts and the drilled and tapped holes for the conductor connection hardware before being cut-to-length to form a connector having the desired number of side-by-side posts all machined from one block. The process produces an improved and yet low cost connector.

14 Claims, 2 Drawing Sheets

CUT COUNT
DE BURR
TAP
DRILL
DRILL
MILL
HOLLOW MILL

METHOD OF MAKING ELECTRICAL CONNECTORS

DISCLOSURE

This invention relates generally as indicated to electrical connectors and a method of making such connectors, and more particularly to high ampacity underground bus type connectors widely used in utility distribution systems, and to an extrusion-machining method of making such connectors.

BACKGROUND OF THE INVENTION

Underground and submersible junction bus connectors are widely used in utility distribution systems. Typical of such connectors are the connectors sold under the trademark ESP® by Eritech, Inc. of Aberdeen, N.C., under the model designations UC, HFS, RD, UCD, BRD, and UCB. Such connectors are commonly characterized by a rigid bar or bus from which projects a plurality of relatively closely spaced circular posts. The thickness of the bar or bus may typically be about one tenth or less the projection of the posts. The number of posts may vary from as few as two to as many as eight or more. Such submersible connectors are widely used in connections to transformers usually underground in electrical power distribution systems.

There are generally two types of such connectors. One employs hollow posts for each terminal or outlet and one or more set screws to clamp and secure the end of the conductor within each hollow post. Another type utilizes a flat pad on the end of an otherwise solid post. One or more compression fasteners secure a conductor lug to the flat pad. The flat pad may extend for approximately the outer two thirds of the post, and the outer end of the pad surface may include an alignment recess interfitting with the conductor lug to maintain lug and post alignment. With such connectors, high amperage connections can quickly be made.

Because of the complex configuration of the connectors which include a lot of non-parallel surfaces, they are typically made by fabrication with weldments or from aluminum alloy castings, all at considerable cost. One of the principal cost problems in casting is that separate molds or dies are required for each model of connector, and within the model for each number of terminals or outlets. Accordingly, the investment in molds and core molds, or dies alone is staggering.

Moreover, the castings have to be made in a job shop foundry or die casting shop which further raises the cost. While some large scale foundries or die casting shops can afford the environmental strictures now required, many smaller foundries or shops can not, and many have closed, requiring importation of castings and/or much higher costs. In addition to higher costs, uncertainty of supply is a problem with castings.

In addition to the economic and environmental problems, castings present some technical problems as well. The surface texture is rather rough which is not ideal for higher amperage electrical connections. They require a considerable amount of grinding or surface finishing after casting and this is usually a manual labor intensive operation. They still require tapping of holes for clamping or set screws, and the casting makes alignment and jigging problems for this more complex and less accurate. Also, the physical properties and microstructure of castings can be less than desirable. For example, an extruded and machined part will have considerably higher mechanical strength, better conductivity, better appearance, and improved surface contact with the conductor or lug.

The extrusion process, particularly hot extrusion, has been widely used to produce a variety of parallel surface shapes including some electrical connectors. Such connectors have relatively simple square, rectangular or other parallel face surface shapes, and secondary machining operations are generally limited to drilling and tapping in such parallel face surfaces. Examples of such extruded connectors are those sold under the trademark ESP® by Eritech, Inc. of Aberdeen, N.C., under the model designations UP, UPSO, UPM, UPT and UPL. Using the extrusion process to produce such relatively simply parts results in quality connections which are economical to produce.

It would, accordingly, be desirable to be able to produce the more complex connectors having a lot of non-parallel surfaces by an extrusion-machining process to produce both improved and lower cost connectors.

SUMMARY OF THE INVENTION

The present invention utilizes an extrusion-machining process to form the more complex round post connectors. A generally rectangular in cross section extrudate is formed of a conductive metal alloy such as aluminum. The shorter sectional dimension is approximately the diameter of the posts, while the longer dimension is the height of the posts, plus the thickness of the bus or bar from which the posts will project. One narrow end is provided with a slight center triangular ridge with two sloping symmetrical sides. The slight point or apex formed will be along the exterior of the bar or bus and facilitates the dip coating of the connector with electrical insulation material without the entrapment of air. If the flat pad form of the connector is formed, the extrudate is in the sectional form of an L, with the extruded surface interior of the long leg of the L forming the pad to which the conductor lug is secured in compression.

After the extrudate is cooled, it is cut to bar stock lengths necessary for storage, bundling or shipment. Lengths of sixteen feet or more can readily be accommodated for shipment.

The conductive metal bar stock is then delivered to a machine shop and used as stock to pass longitudinally and incrementally in a stepwise fashion through a manufacturing system machining line. The machining line includes at least four stations. The spindles of each station are spaced along the line a whole multiple of the space between the posts, ports or terminals to be formed. Some of the spindles are at right angles to others and each machining operation may be ganged to perform steps on more than two ports or terminals at once, with the incremental movement of the stock being distanced accordingly.

Although the precise order of the machining operations may vary, the posts or conductor terminals are formed with a special hollow mill and any excess metal removed from between the posts by an ordinary mill. The hollow mill includes an interior pressure flush of coolant to keep chips away from the exterior post surface being formed. The post is formed with a centered or slightly eccentric conductor hole or port. If the conductor port is eccentric, the barrel of the post at the thicker part near its end is formed with one or more set screw holes by drilling and tapping, the spindle of each such drilling and tapping operation being at right angles to the milling.

If a pad type connector is being formed with the L-shape extrudate bar, the conductor port drilled axially in the post is not required. The milling of the post alone will provide the rounded and axially flatted post, so that one or more threaded holes may be formed directly through the flatted part of the post by the right angle drilling and tapping operations. An alignment recess may also be formed in this manner.

The machined bar stock which now has the posts projecting from the slightly crowned unformed solid bar side is deburred and cut between the posts into the final parts which may include a few or a relatively large number of posts. The parts are ready for dipping and assembly.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figures 1, 2, 3, 4, 5, 6:
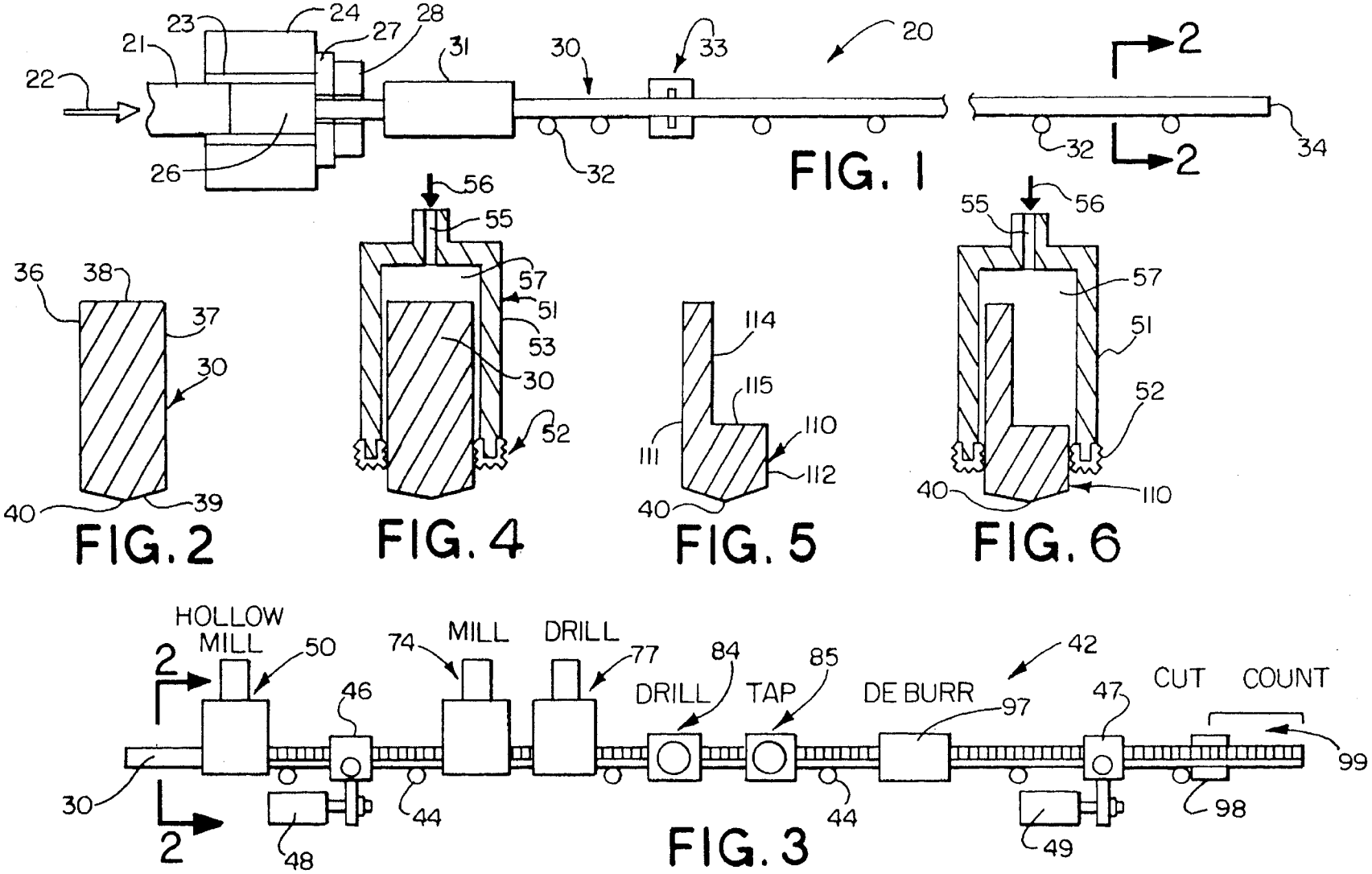
FIG. 1 is an extrusion line in accordance with the present invention, the extrudate being cut to bar stock lengths.
FIG. 2 is an enlarged transverse section of one form of the bar stock for making a hollow post connector.
FIG. 3 is an illustration of a machining line through which the bar stock is indexed to machine the conductors of the present invention.
FIG. 4 is a transverse section of a center flush hollow mill forming a post.
FIG. 5 is a transverse section of another form of bar stock extrudate for making a flat pad compression type connector.
FIG. 6 is a view like FIG. 4 showing the hollow milling of the post with the extrudate bar stock of FIG. 5.

Referring now to the drawings and initially to FIG. 1, there is illustrated an extrusion line shown generally at 20. The extrusion line at the left hand end as shown includes a high pressure ram 21, being urged in the direction of the arrow 22, and moving within liner 23 of container body 24. The ram is pressing against a hot or heated billet 26, extruding the billet through die 27, held in place by die backer 28.

The extrusion process forms the hot billet into an elongated bar shown generally at 30. The bar passes through a cooler 31 and is supported on rollers or other suitable conveyors indicated at 32, to pass through a cutoff 33. The cutoff 33 is operable in response to the length of extruded stock passing through the cutoff and may be actuated by a linear measure or a flag positioned at the cutoff end 34 to cut the extruded stock into bar stock lengths. The lengths of the bar stock may be determined as a convenience for storage and shipment. Generally, lengths of sixteen feet or more may readily be accommodated for shipment in bundles.

The metal of the billet 26 and the extruded bar stock 30 is a conductive metal and preferably an aluminum alloy.

Referring now to FIG. 2, there is illustrated one form of the extruded bar stock in section in accordance with the present invention. The bar stock is generally rectangular and includes parallel sides 36 and 37 with a flat top or end 38 and a ridged bottom or end 39. The slight triangular ridge indicated at 40 facilitates the dipping of the connector when machined into an insulating material. The connector will be dipped vertically as shown in FIG. 2, and ridge 40 precludes the entrapment of air on the bottom of the connector. The ridge is preferably formed in the extrusion process by the extrusion die.

The conductive metal bar stock is then delivered to a machine shop and used as stock to pass longitudinally and incrementally in stepwise fashion through a machining line such as seen generally at 42 in FIG. 3. The bar stock is supported on rollers indicated at 44 and move through lateral guides, not shown. The bar stock is gripped by clamps indicated at 46 and 47 which laterally grip the bar stock and which are attached to indexing piston cylinder assemblies 48 and 49, respectively. In this manner, the bar stock can reindex to the right as seen in FIG. 3, a few centimeters at a time, for example, to position the bar stock for machining at the various stations illustrated, and cutoff.

The stock initially passes through a hollow mill station shown generally at 50, and the hollow mill is illustrated at 51 in FIG. 4. The hollow mill rotates about its vertical axis as shown and includes relatively fine cutting teeth indicated at 52 which are on the end, interior, and exterior of the tubular mill body 53. The hollow mill includes an axial passage 55 for coolant under pressure as indicated by the arrow 56 which floods the interior of the hollow mill as indicated at 57. It will be appreciated that the axial movement of the hollow mill also creates pressure interiorly which additionally causes the coolant to be expelled downwardly between the clearance between the extrudate body and the teeth 52, thus expelling any chips formed away from the exterior of the post surface being formed by the hollow mill. The hollow mill proceeds to approximately the depth indicated in FIG. 4. It is preferred to retract the hollow mill relatively slowly so that no coolant containing chips may be drawn back into the interior of the hollow mill past the surface being formed.

After the formation of the exterior of the post, the extruded stock is indexed to form the next post. Although the illustration shows only a single step, it will be appreciated that the machining operations may be ganged to perform steps on the extruded stock concurrently and thus to form more than two posts or terminals at once, with the incremental movement of the extruded stock being distanced accordingly. The same is true of the other steps hereinafter described.

Figure 7:
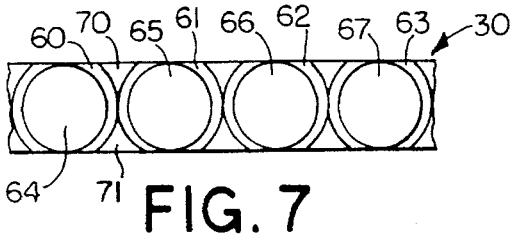
FIGS. 7 and 8 are fragmentary top and side views of the bar stock after the operation of the hollow mill.
Figure 8:
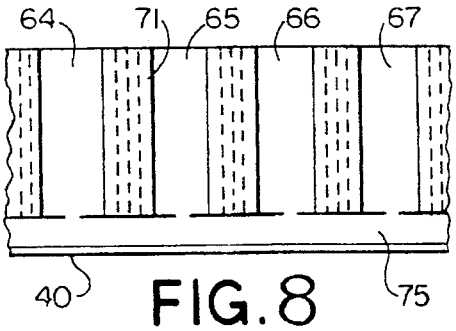

Referring now to FIGS. 7 and 8, there is illustrated the extruded stock after the formation of the exterior of the posts by the hollow mill. The hollow mill cuts deep annular grooves seen at 60, 61, 62 and 63 in FIG. 7. The circular posts formed by the hollow mill are shown at 64, 65, 66 and 67. The hollow mill leaves a small triangle or cusp of metal on each side of the bar stock as indicated at 70 and 71. This unwanted metal is removed in milling station 74 by a relatively small CNC controlled milling cutter which may move in the X, Y and Z direction. It will be appreciated that more than one milling station 74 may be employed along the line, one for each side of the extruded stock.

As seen in FIG. 8, the formation of the posts leaves a portion of the stock indicated at 75 uncut. This side of the block is continuous and forms a connecting bus bar from which the posts project. The axial height of the posts may vary, particularly if one or more clamp fasteners or set screws is to be employed. The post may project up to ten times or more the thickness of the unmilled or unmachined part of the extruded stock.

Figure 9:
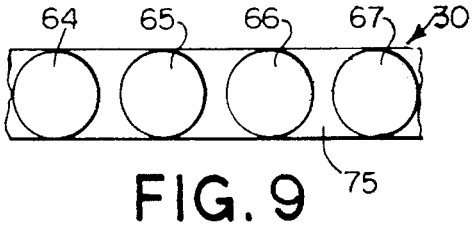
FIGS. 9 and 10 are fragmentary top and side views of the bar stock after the milling away of the excess metal between the posts.
Figure 10:
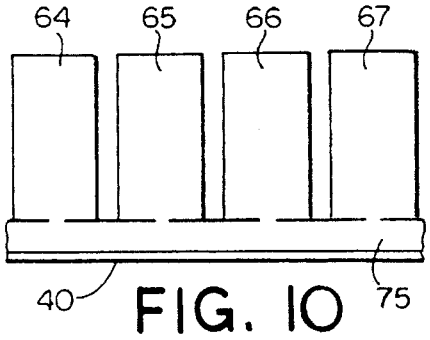

After the removal of the metal between the posts, the extruded stock appears as seen in FIGS. 9 and 10. It is here noted that the diameter of the posts or the internal diameter of the cutting teeth of the hollow mill are substantially the same as the width of the bar stock between the two long parallel side 36 and 37. Accordingly, the posts have the same diameter as the width of the connecting bus or bar 75.

Figure 11:
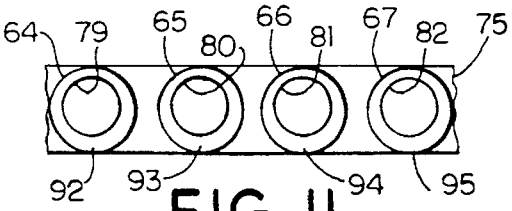
FIGS. 11 and 12 are fragmentary top and side views of the bar stock after the drilling of the conductor receiving hole in each post.
Figure 12:
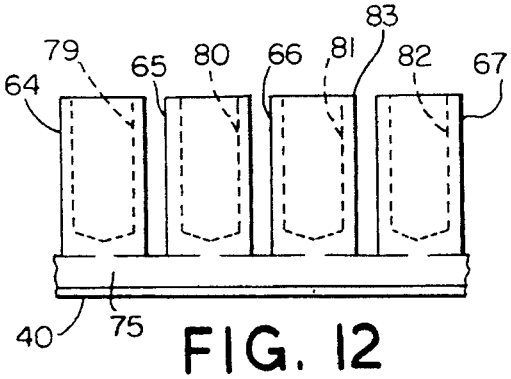

After the posts have been formed as seen in FIGS. 9 and 10, they move to a drill station 77 which drills blind holes seen in FIGS. 11 and 12 at 79, 80, 81 and 82 axially in the respective posts. The holes are drilled approximately the full height of the posts, but eccentrically of the axis of the post. Either concurrently with the hollow mill or blind hole drilling, or as a separate operation, the relatively sharp outer corner of the post indicated at 83 may be chamfered.

Figure 13:
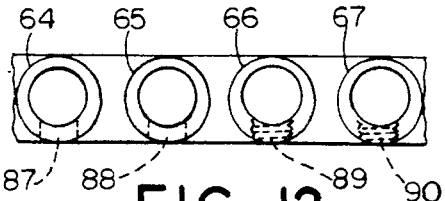
FIGS. 13 and 14 are fragmentary top and side views of the bar stock showing the drilling and tapping of a set screw hole in the barrel wall of the posts.

Next, the bar stock is indexed through drill and tap stations shown at 84 and 85 in FIG. 3. The axis of both such drill and tap tool stations is normal to the axis of the stations 50, 74 and 77. The drill station simply drills a hole in the thicker barrel wall as indicated at 87 and 88 in FIG. 13. At the tap station, such holes are then tapped to provide the threads 89 and 90 in such holes which are normal to the axis of the post.

As noted, the holes 79 through 82 are drilled eccentrically of the post to provide a larger wall thickness on one side of the post as indicated at 92, 93, 94 and 95 in FIG. 11. It is in this area of largest wall thickness of the formed barrel that the holes 87 and 88 are drilled and subsequently tapped.

Figure 14:
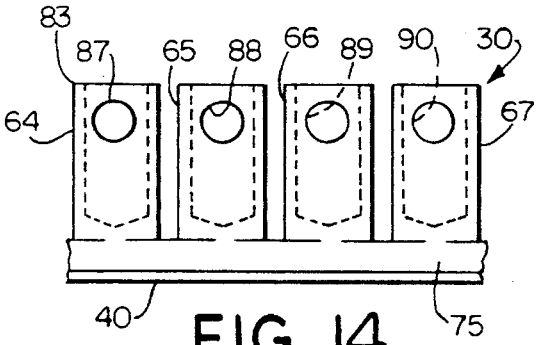

The bar stock is now in the configuration seen more clearly in FIG. 14 and passes finally through a deburring station shown at 97 in FIG. 3. The deburring station principally cleans out and deburrs any burrs formed in the drilling and threading operations.

Finally, the bar stock passes through a cutter 98 which counts the posts formed as indicated at 99 and then cuts the bar stock symmetrically between such posts to form an electrical connector which may include anywhere from two to eight posts. After cutting and cleaning, the connector is ready for dipping, assembly and shipment.

Figure 15:
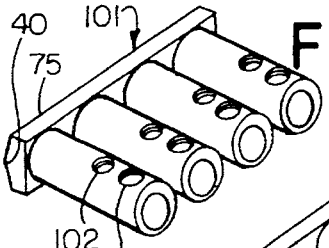
FIGS. 15 and 16 are isometric illustrations of cut-to-length connectors which may be formed using the hollow post extrudate of FIGS. 2 and 4, for example.

Referring now to FIG. 15, there is illustrated a four post connector shown generally at 101 which includes a somewhat longer post or barrel and also each post includes two set screw holes as seen at 102 and 103.

Figure 16:
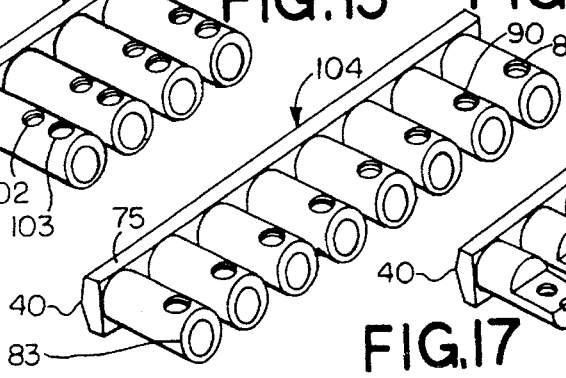

In FIG. 16, there is illustrated a connector 104 which has eight side-by-side hollow posts and only a single set screw hole in each post.

In order to make a flat pad compression type connector, the extrusion profile seen in FIG. 5 at 110 is employed. The profile 110 is generally similar to the profile of the FIG. 2 embodiment in that it includes parallel sides 111 and 112 and the triangular ridge 40 on the bottom. The top, however, is cut away into the L-shape configuration shown, forming an extruded flat surface 114 which meets the right angle flat surface 115. The extruded stock is formed in the same manner but the die configuration is different to produce the generally L-shape extrusion seen in FIG. 5.

The extruded stock is cut to bar stock length and shipped to the machine shop to be passed through the machining line such as seen in FIG. 3. Since no hollow post will be formed, the drill step shown by station 77 may then be omitted. The hollow mill 51 seen in FIG. 6 forming the posts on the extruded bar stock is the same as employed in FIG. 4. Excess material will be milled from between the posts and instead of passing through station 77, the stock will then pass directly into the drill and tap stations 84 and 85 to form one or more fastener holes in the flat pad surface of the post. The drill station may also form an interlocking recess at the axial end of the pad which interfits with a projection on the lug of the conductor to be secured to the flat pad by the clamping fasteners. This maintains lug and post alignment.

After deburring, the extruded and machined bar stock is cut to length measuring or counting the posts. The part after cleaning, dipping and assembly is ready for use.

Figure 17:
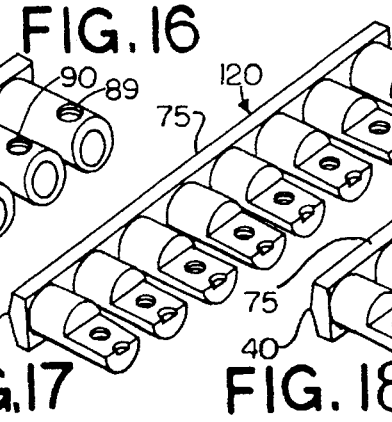
FIGS. 17 and 18 are isometric illustrations of cut-to-length connectors which may be formed using the flat pad extrudate of FIGS. 5 and 6, for example.

FIG. 17 illustrates an eight post connector 120 formed from the L-shape bar stock of FIGS. 5 and 6. The flat pad surface 114 formed by the extrusion die is seen in FIG. 17. The connector posts each include a single tapped fastener hole 121 and the interlocking indentation 122 at the outer end.

Figure 18:
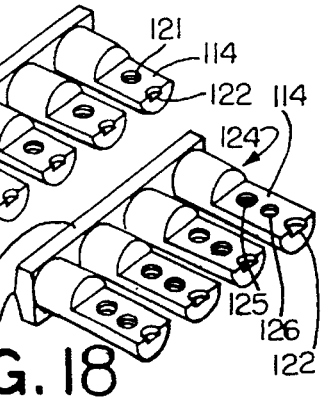

FIG. 18 illustrates a connector 124 but having two tapped fastener holes 125 and 126 in each flat pad surface 114 in addition to the interlocking indentation 122.

Although the axial height of the posts may vary, it is preferred that the posts be from about four to about twelve times the thickness of the bus bar 75 formed in the machining process. A post height to bar thickness ratio of 10 to 1 would be typical, but is higher if two set screw or clamping fastener holes are employed.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A method of making an electrical connector comprising the steps of machining an elongated generally rectangular cross-sectioned extruded bar stock of conductive metal by hollow milling the bar stock transversely from one end to a depth spaced from the opposite end to form posts projecting from the unmilled end of the bar stock, removing any excess metal between the posts to the same depth as said posts, and forming and tapping a hole in said posts normal to the longitudinal axis of the post to enable an electrical conductor to be clamped to the post, and then cutting the bar stock to length between posts to form an electrical connector having at least two posts.

2. A method as set forth in claim 1 wherein the end of the extruded bar stock opposite the posts is provided with a triangular ridge enabling the connector to be at least partially dipped without the entrapment of air.

3. A method as set forth in claim 1 including the step of axially longitudinally drilling a hole in said posts to form a projecting barrel, and then drilling and tapping a hole through the wall of the barrel whereby a conductor may be clamped inside the barrel.

4. A method as set forth in claim 3 including the step of drilling the hole in the post eccentrically of the post to form a barrel, and then drilling and tapping the hole through the wall of the barrel at the point of largest wall thickness.

5. A method as set forth in claim 4 including the step of drilling and tapping at least two holes through the wall of each barrel.

6. A method as set forth in claim 1 wherein each post is formed by a hollow mill.

7. A method as set forth in claim 6 wherein said hollow mill has cutting teeth on its end, interior, and exterior.

8. A method as set forth in claim 6 including the step forcing coolant under pressure through the center of the hollow mill to keep cutting chips away from the surface being formed.

9. A method as set forth in claim 6 wherein the interior diameter of the hollow mill is substantially the same as the width of the bar stock.

10. A method as set forth in claim 1 wherein said bar includes a recessed surface which forms a flat on the projecting end of each post to which a conductor is clamped.

11. A method as set forth in claim 10 including the step of forming the flat as an extruded surface.

12. A method as set forth in claim 11 including the step of forming the flat by extrusion whereby the flat extends axially of the post when milled for about two thirds or more of the axial projection of the post.

13. A method as set forth in claim 12 including the step of forming one or more fastener holes in said flat pad surface to enable the lug of a conductor to be secured thereto in compression.

14. A method as set forth in claim 13 including the step of forming an interlocking recess in the axial outer end of each flat pad surface operative to interface with a mating conductor terminal lug to prevent twisting.

* * * * *

Adverse Decisions in Interference

Patent No. 5,555,620, Antonius M. Kies, METHOD OF MAKING ELECTRICAL CONNECTORS, Interference No. 103,940, final judgment adverse to the patentee rendered November 4, 1997, as to claims 1-14.

*(Official Gazette April 21, 1998)*